US011624234B2

(12) United States Patent
Zilberbaum et al.

(10) Patent No.: US 11,624,234 B2
(45) Date of Patent: Apr. 11, 2023

(54) MOTORIZED BLIND ACTUATOR WAND

(71) Applicant: Sunsa, Inc., Fulton, MD (US)

(72) Inventors: Adam Zilberbaum, Baltimore, MD (US); Gholamali Malekpour, San Diego, CA (US)

(73) Assignee: Sunsa, Inc., Fulton, MD (US)

( * ) Notice: Subject to any disclaimer, the term of this patent is extended or adjusted under 35 U.S.C. 154(b) by 0 days.

(21) Appl. No.: 17/143,102

(22) Filed: Jan. 6, 2021

(65) Prior Publication Data

US 2021/0404248 A1 Dec. 30, 2021

Related U.S. Application Data

(60) Provisional application No. 62/957,528, filed on Jan. 6, 2020.

(51) Int. Cl.
*E06B 9/322* (2006.01)
*E06B 9/74* (2006.01)

(52) U.S. Cl.
CPC ..... *E06B 9/322* (2013.01); *E06B 9/74* (2013.01)

(58) Field of Classification Search
CPC . E06B 9/32; E06B 9/322; E06B 9/326; E06B 9/38; E06B 9/74; E06B 9/68; E06B 9/76; E06B 9/78; E06B 2009/3222; E06B 2009/6809; E06B 2009/6818; E06B 2009/6845
See application file for complete search history.

(56) References Cited

U.S. PATENT DOCUMENTS

| | | | | |
|---|---|---|---|---|
| 1,978,152 | A | 5/1931 | Ward | |
| 4,096,903 | A | 6/1978 | Ringle, III | |
| 4,644,990 | A | 2/1987 | Webb et al. | |
| 4,869,308 | A | 9/1989 | Chang | |
| 4,914,360 | A | 4/1990 | Hsieh et al. | |
| 4,956,588 | A * | 9/1990 | Ming | E06B 9/70 318/434 |
| 4,979,550 | A * | 12/1990 | Long | E06B 9/74 160/5 |
| 5,391,967 | A | 2/1995 | Domel et al. | |
| 5,444,339 | A * | 8/1995 | Domel | E06B 9/307 318/400.41 |
| 5,495,153 | A | 2/1996 | Domel et al. | |
| 5,547,008 | A | 8/1996 | Sullivan | |
| 5,577,542 | A | 11/1996 | Hung | |
| 5,603,371 | A | 2/1997 | Gregg | |
| 5,760,558 | A * | 6/1998 | Popat | E06B 9/32 160/188 |
| 6,060,852 | A | 5/2000 | Domel et al. | |
| 6,112,798 | A | 9/2000 | Cheng | |
| 6,369,530 | B2 | 4/2002 | Kovach et al. | |
| 6,910,515 | B2 | 6/2005 | Nien | |
| 7,204,292 | B2 | 4/2007 | Nien | |

(Continued)

*Primary Examiner* — Johnnie A. Shablack
(74) *Attorney, Agent, or Firm* — Perkins Coie LLP

(57) ABSTRACT

Systems and methods for controlling a motorized wand in order to operate at least one set of blinds is disclosed herein. Certain embodiments include a motorized wand having features to enable manual or remote control of slats or louvres to at least one set of blinds, wherein a user may program specific actions through a software or app-based device. In other aspects, a user may switch between manual and automatic operation of the wand through specified, simple steps.

20 Claims, 21 Drawing Sheets

(56) References Cited

U.S. PATENT DOCUMENTS

| | | | | |
|---|---|---|---|---|
| 7,673,667 | B2 * | 3/2010 | Domel | E06B 9/68 160/168.1 P |
| 7,919,939 | B2 * | 4/2011 | Mosbrucker | E06B 9/322 318/16 |
| 8,723,454 | B2 * | 5/2014 | Skinner | E06B 9/72 318/16 |
| 8,981,681 | B2 * | 3/2015 | Malekpour | H02K 49/104 318/40 |
| 9,206,638 | B1 * | 12/2015 | Malekpour | E06B 9/368 |
| 9,371,691 | B2 * | 6/2016 | Yu | E06B 9/322 |
| 9,489,834 | B2 * | 11/2016 | Hall | E06B 9/326 |
| 9,599,996 | B2 * | 3/2017 | Lagarde | E05F 15/70 |
| 9,670,723 | B2 * | 6/2017 | Pham | E06B 9/68 |
| 9,765,568 | B2 * | 9/2017 | Colson | E06B 9/78 |
| 9,879,475 | B2 * | 1/2018 | Mullet | G05B 19/042 |
| 10,058,205 | B2 * | 8/2018 | Rivera | A47H 5/02 |
| 10,072,458 | B2 * | 9/2018 | Mullet | E06B 9/368 |
| 10,104,997 | B2 * | 10/2018 | Pham | H02P 1/16 |
| 10,156,093 | B2 * | 12/2018 | Hall | E06B 9/307 |
| 10,648,232 | B2 * | 5/2020 | Colson | E06B 9/82 |
| 10,799,056 | B2 * | 10/2020 | Mullet | A47H 5/0325 |
| 10,851,587 | B2 * | 12/2020 | Anthony | H01H 19/46 |
| 11,377,906 | B2 * | 7/2022 | Jang | E06B 9/42 |
| 11,414,927 | B1 * | 8/2022 | Popat | E06B 9/78 |
| 2005/0189078 | A1 | 9/2005 | Whiting | |
| 2006/0185799 | A1 | 8/2006 | Kates | |
| 2006/0288644 | A1 | 12/2006 | Vasquez | |
| 2008/0303686 | A1 | 12/2008 | Mosbrucker | |
| 2009/0273307 | A1 | 11/2009 | Mosbrucker | |
| 2012/0193035 | A1 | 8/2012 | Malekpour | |
| 2017/0218700 | A1 * | 8/2017 | Lin | E06B 9/80 |
| 2017/0362888 | A1 * | 12/2017 | Vinogradova | E06B 9/32 |
| 2018/0106100 | A1 * | 4/2018 | Foley | E06B 9/74 |
| 2018/0238108 | A1 * | 8/2018 | Wileman | E06B 9/68 |
| 2019/0071926 | A1 * | 3/2019 | Hall | E06B 9/364 |
| 2020/0138226 | A1 * | 5/2020 | Mullet | A47H 5/06 |
| 2020/0263494 | A1 * | 8/2020 | Hebeisen | E06B 9/322 |
| 2020/0332595 | A1 * | 10/2020 | Anthony | E06B 9/72 |
| 2021/0131176 | A1 * | 5/2021 | Schmidt | E06B 9/322 |
| 2022/0202227 | A1 * | 6/2022 | Pham | H02P 1/16 |

* cited by examiner

MOTORIZED BLIND ACTUATOR WAND

FIELD OF THE INVENTION

This invention relates generally to the filed of devices and apparatuses involved in the functioning of window blinds and window treatments. Specifically, the present invention provides an improved solution to the field of motorized wands to remotely control the opening and closing of window blinds.

BACKGROUND OF THE INVENTION

There are many versions of window blinds on the markets. One common version comes in vertical and horizontal configurations that open and close via a manually rotated wand connected to an embedded mechanism that operates shafts and gears connected to wires or strings connected to the slats that make up the blind.

A typical manual window blind wand is a solid small diameter rod or shaft that hangs from the spindle which when rotated open and closes a window blind. Some embodiments may replace the manual wand with a motorized wand of the same general size and length of a manual wand. For example, some embodiments may replace the manual wand provided in an original blind set or may be provided as part of a blind set by a manufacturer.

Motorized wands of the prior art have been suggested and utilized as potential solutions to the limitations of a manual wand.

U.S. Pat. No. 9,206,638 to Malekpour teaches an apparatus that can remotely control the opening and closing of one or more blinds, with the apparatus taking the form of a motorized wand. Specifically, the motorized wand of Malekpour comprises a gear box, motor, a first gear, a second gear and a magnetic clutch.

U.S. Pat. No. 6,910,515 to Nien discloses an electrically operated blind that comprises a headrail, driving mechanism, blind body and a control mechanism, all contained within the blind device. However, this invention requires substantial power input and involves a complicated coupling of the motor to a suspension rod.

There is a need in the state of the art to improve upon the motorized wands of the prior art to include more efficient and streamlined designs to allow functionality in a minimal form factor in order to remotely control one or more window blinds simultaneously.

SUMMARY OF THE INVENTION

The present invention provides for a motorized wand for controlling the opening and closing of at least one set of blinds, comprising: a printed circuit board assembly, a geared motor an encoder, and a housing, wherein the encoder is used to determine a position of slats or louvers of the at least one set of blinds. In another aspect, the motorized wand of the present invention further comprises a current sensor to control the amount of current to the geared motor, thereby acting as a clutch. More preferably, the current sensor may operate as a torque control, allowing for current to be adjusted depending on size and weight parameters of the slats or louvers at least one set of blinds.

Optionally, the motorized wand further comprises an antirotating element to allow a spindle coupling component to rotate instead of the wand rotating. Preferably, the spindle coupling component is positioned at the tip of the wand. Optionally, the motorized wand may also allow a user to control the wand manually.

In another aspect, the motorized wand of the present invention further comprises a accelerometer/gyroscope component for use in the wand sensing directional movement. Optionally, the motorized wand further comprises a speed control element which may dictate the rate of opening or closing of the slats or louvers at least one set of blinds.

In an alternative embodiment, the motorized wand of the present invention further comprises at least one pre-setting element wherein the wand is programmed to execute an action based on a parameter selected from the group consisting of a predetermined time, a predetermined temperature, a predetermined position or a predetermined amount of light, or any combinations thereof. Optionally, a predetermined current threshold is established using the current sensor to shut off the geared motor upon reaching a particular current level.

In another embodiment, the present invention further comprises the motorized wand to be controlled by a separate device via an app through a wireless frequency connection. Preferably, the motorized wand can remotely control one set of blinds or multiple sets of blinds.

BRIEF DESCRIPTION OF THE DRAWINGS

The novel features of the present invention are set forth herein embodied in the form of the claims of the invention. Features and advantages of the present invention may be best understood by reference to the following detailed description of the invention, setting forth illustrative embodiments and preferred features of the invention, as well as the accompanying drawings further described below.

DETAILED DESCRIPTION OF THE INVENTION

For convenience, one or more embodiments may be referred to herein as the "S-Wand" It should be noted, however, that some embodiments may reflect one or more other shapes (e.g., a rod with multiple sides, such as a hectogon, hexagon, etc., or other shaped housing) or non-wand-like objects. In some embodiments, the S-Wand may be operated by an app through a smart phone or operate automatically by pre-set conditions (e.g., time of day or conditions sensed by the S-Wand) or use of physical remote or if desired manually like a standard solid wand. The S-Wand may be powered by batteries or by an external power source via a cable (e.g., such as DC and solar).

Various other aspects, features, and advantages of the invention will be apparent through other sections herein. It is also to be understood that both the foregoing general description and the following detailed description are examples and not restrictive of the scope of the invention.

Figure 1:
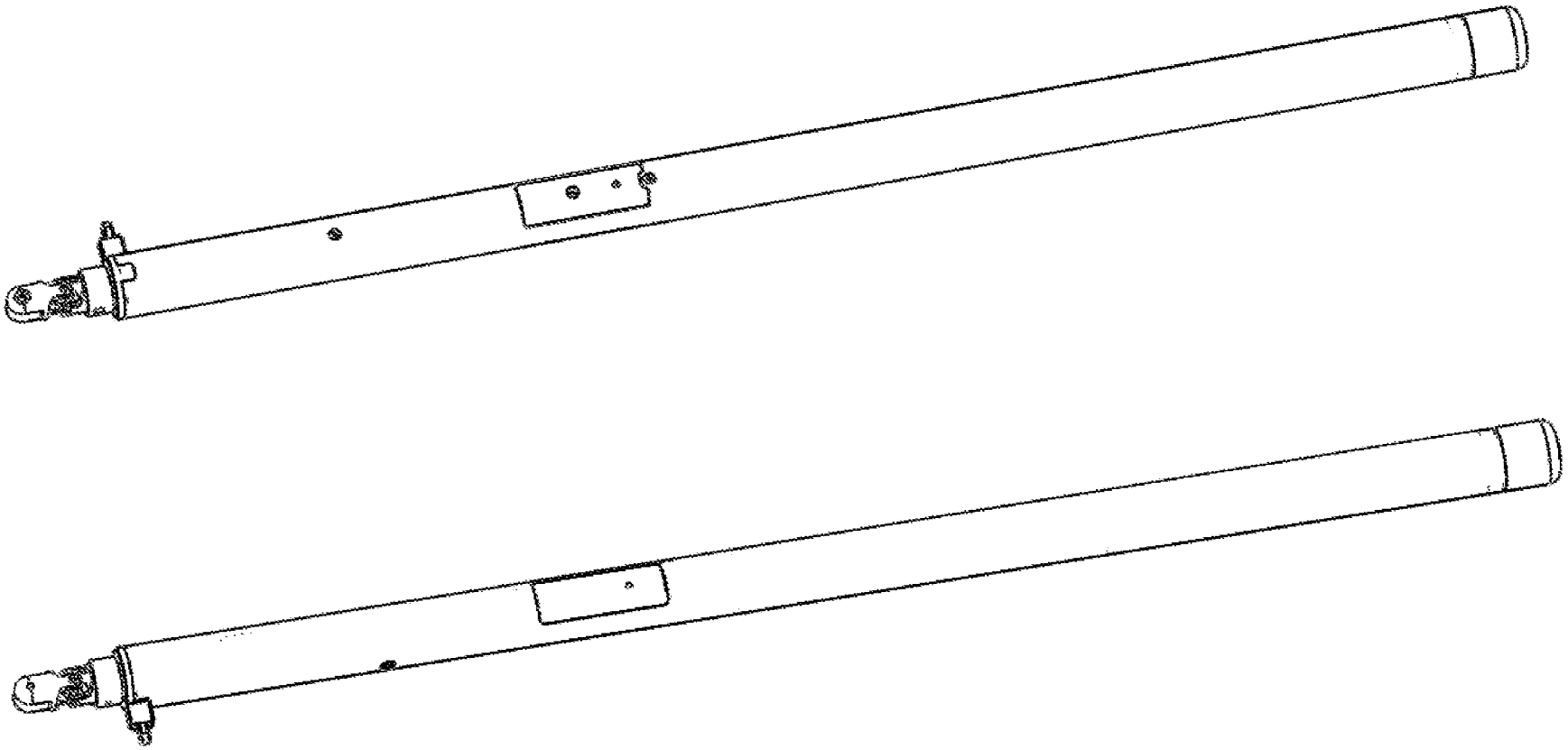
FIG. 1 shows preferred embodiments of the motorized wand of the instant invention.
Figure 2:
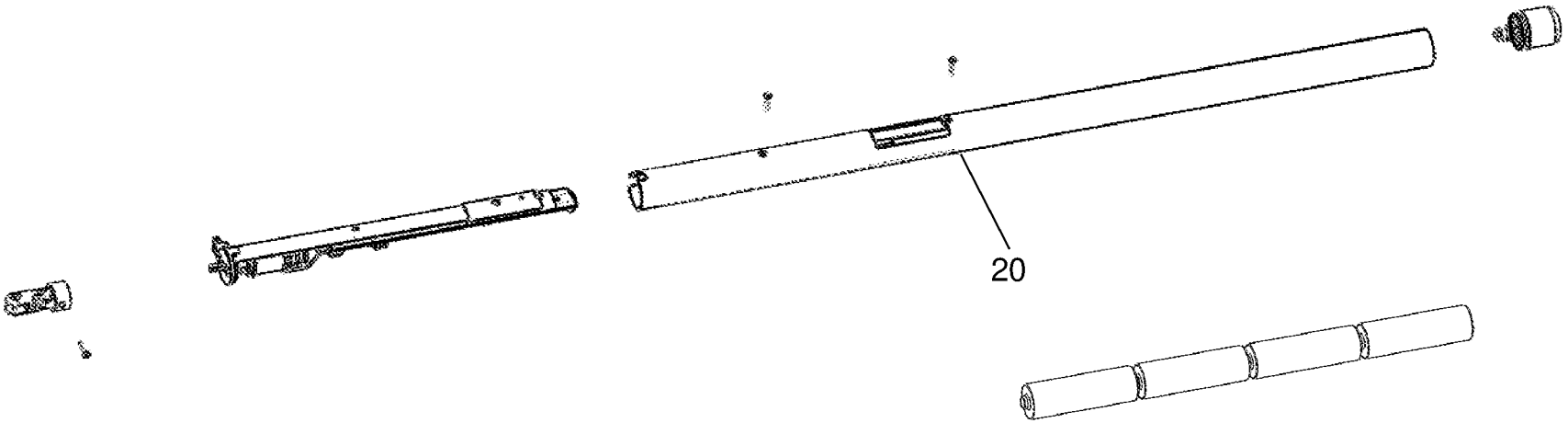
FIG. 2 shows an exploded view of the preferred embodiment of the present invention.

In certain embodiments, the S-Wand may include a tubular housing assembly 20, an electronics and motor insert assembly, an end cap assembly, a spindle coupling assembly, or other components (FIGS. 1-2). Although some embodiments are described herein with a tubular housing, it should be noted that other embodiments may include other types of housings in lieu of the tubular housing.

Figure 3:
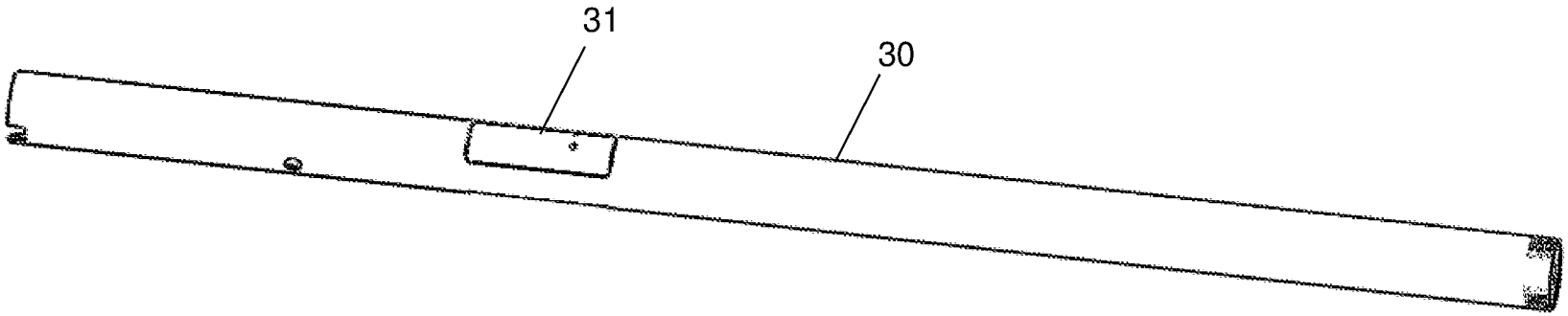
FIG. 3 shows the tubular housing assembly feature of the preferred embodiment of the present invention.

As shown in FIG. 3, in certain embodiments, tubular housing assembly 20 may include an aluminum tube 30 and a plastic window 31. As an example, plastic window 31 may be bonded into a matching opening in aluminum tube 30.

Figure 4:
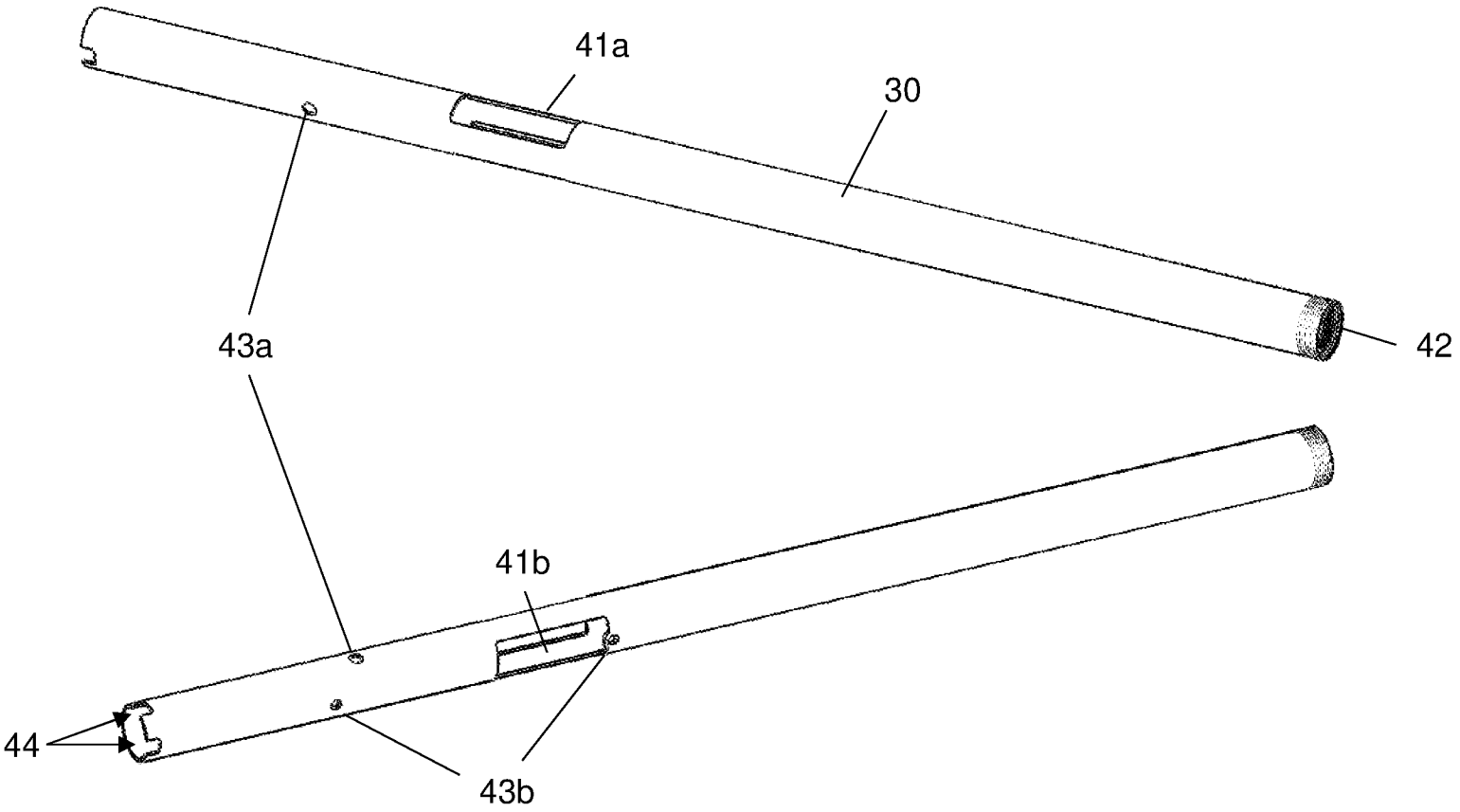
FIG. 4 shows further details of the tubular housing assembly feature of FIG. 3.

In some embodiments, as shown in FIG. 4, tube 30 includes multiple features, such a forward-facing window opening 41*a*, a rearward facing window opening 41*b*, an internal thread at one end 42, a pair of matching countersunk holes 43*b* on the rearward side, or a round hole 43*a* through the side 90° to the forward side and two rectangular notches 44 at the end opposite the threaded end. In some embodiments, tube 30 may be constructed of aluminum for the purpose of rigidity and electric conductivity. In some embodiments, tube 30 may be constructed of other electrically conductive materials (e.g., other metals). In other embodiments, tube 30 may be constructed of non-electrically conductive materials including, but not limited to, plastics, acrylonitrile butadiene styrene (ABS) and other thermoplastic polymers. The non-electrically conductive tube embodiment will result in lower production costs but will require a connection between the PCBA and negative power using a wire or a metal strip.

The outer surface of tube 30 may be left in a natural material state or coated. In certain embodiments, coatings may include spray paint, powder coat, anodize, e-coat, electro-less nickel, etc. In alternative embodiments, although coatings may be applied, one or more specific areas may remain electrically conductive. As an example, if the coating is electrically isolating (e.g., paint), then the aforementioned areas may be uncoated. In one use case, the specific areas that remain electrically conductive may include countersunk holes 43*b*, internal thread 42, or other areas of tube 30. In certain embodiments, the present invention may provide for a shrinkable tube-like material that can be used with varying colors and patterns to give a unique appearance to the wand.

Figure 5:
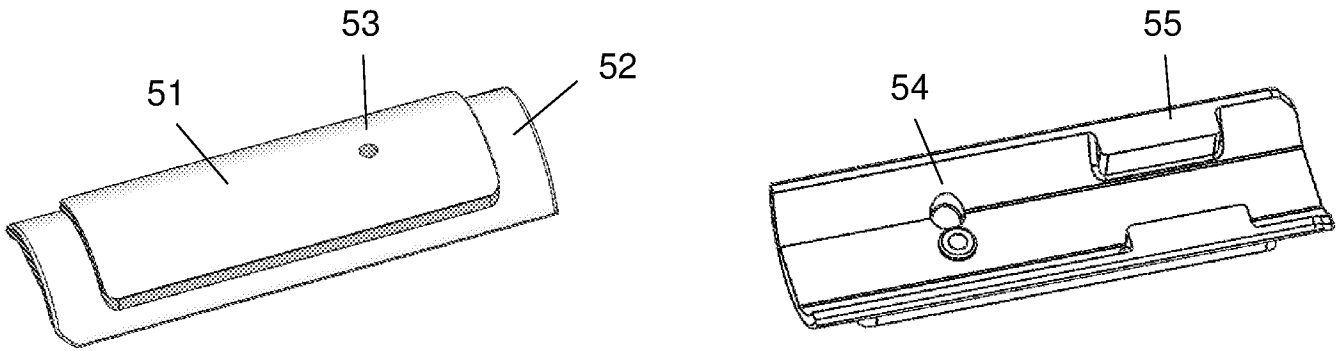
FIG. 5 shows the optional window feature (top view and underside view) in the tubular housing assembly of the motorized wand of the present invention.

In some preferred embodiments, as shown in further detail in FIG. 5, window 41*a*/41*b* may be made of plastic. As an example, the plastic enables wireless signals (WiFi signals, Bluetooth signals, or other signals) to pass through window 41*a*/41*b* without impedance. In some embodiments, window 41*a*/41*b* may be made of alternative materials (e.g., wood) that enable wireless signals to pass through. Window 41*a*/41*b* includes a raised feature 51 that is sized to fit in the forward opening in tube 30. The feature is curved to match the radius of tube 30. Raised feature 51 is surrounded by a curved flange 52 that closely matches the inner diameter of tube 30.

Curved flange 52 is intended to be a bonding surface to adhere to tube 30 by a suitable adhesive. Alternative methods of attaching window 41*a*/42*b* to tube 30 could be used. In some embodiments, alternative methods may include a variety of attachment means, including snap in features, staked in place, ultrasonically welded, screws or other mechanical structural support. The small hole 53 shown is optional and could be used to access a switch with a paper clip or similar sized part. The circular pocket 54 on the inner portion of window 41*a*/42*b* creates a thin wall to allow light to be visible from an internal LED. Other features such as bosses 55 on the inner portion of window 41*a*/42*b* are optional to help with assembly.

Figure 6:
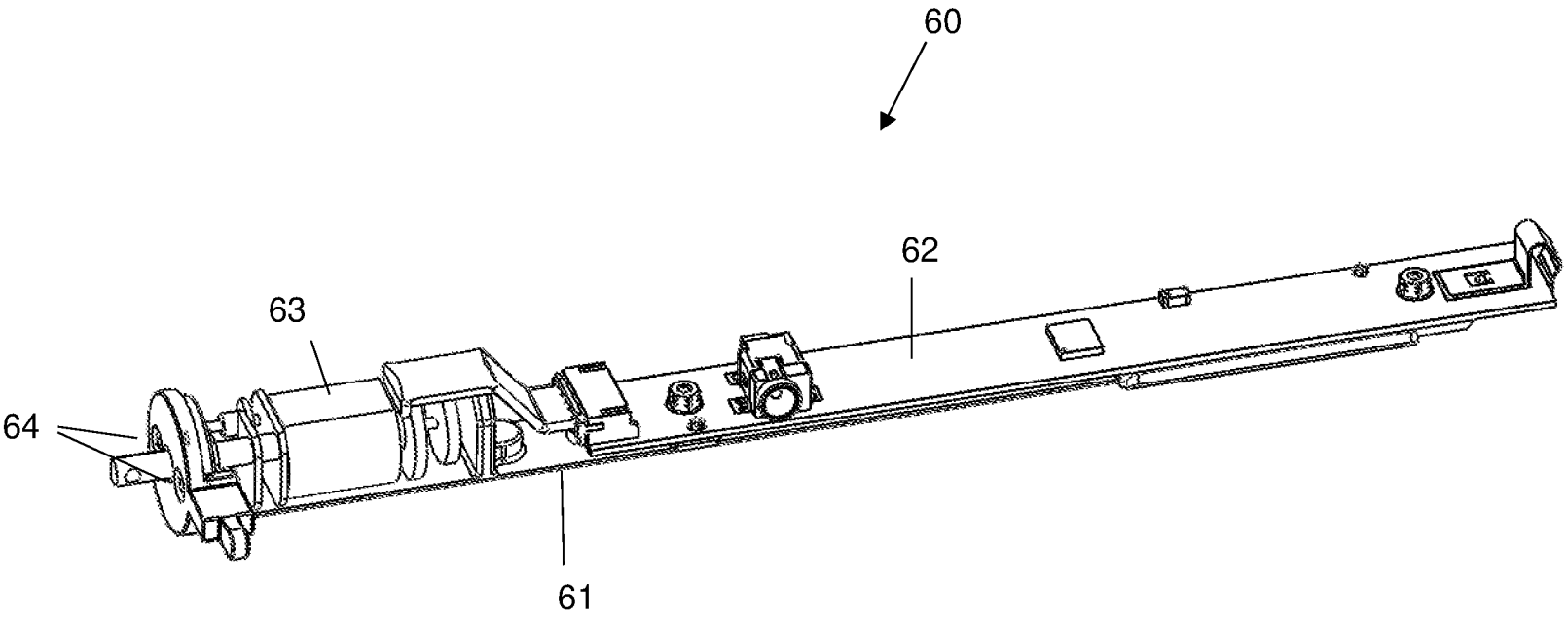
FIG. 6 shows the electronic and motor insert assembly features of the motorized wand.

As shown in FIG. 6, the motorized wand further comprises an electronics and motor insert assembly 60 further comprising a base component 61, a printed circuit board assembly (PCBA) 62, a motor/encoder assembly 63 and holes 64 for screws.

In certain embodiments, base component 61 is a single part made of plastic. In alternative embodiments, base component 61 is made of alternative materials. Base component 61 is, optionally, constructed of multiple pieces and a combination of materials.

Figure 7:
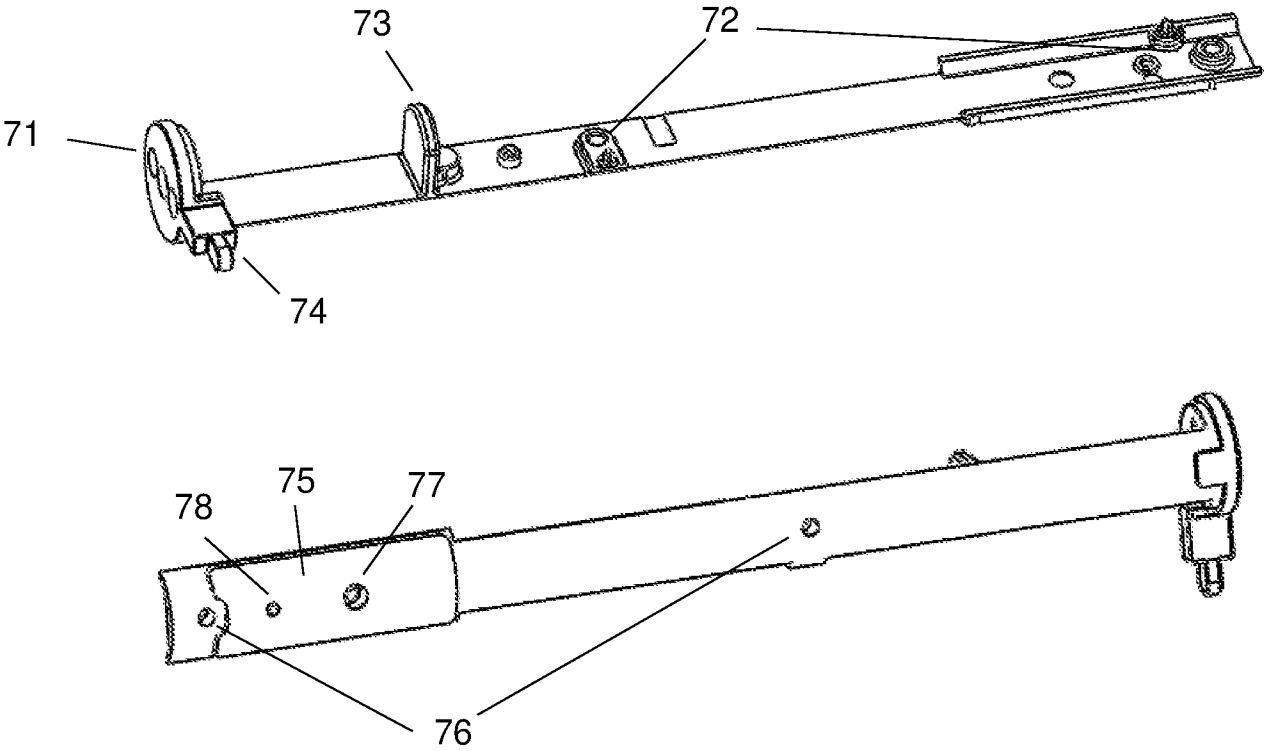
FIG. 7 shows the insert base feature of the preferred embodiment of the present invention.

Base component 61 has many features, as further shown in FIG. 7, including a circular flange with holes 71 for mounting the motor and closing off tube 30, through hole bosses 72 for supporting PCBA 62, a vertical wall 73 for guarding the wire cable from the encoder, a protruding tab 74 on the side of circular flange with holes 71, a raised curved feature 75 that fits in the rearward facing motor on tubular housing 20 and matches the outer radius on the housing, a pair of holes 76 that align to countersunk holes 43*b* in tube 30, a round hole 77 for light access to the inside of tube 30 and an optional hole 78 that serves as a switch access hole as described by small hole 53 from FIG. 5 in the window. In the embodiment shown in FIG. 7, circular flange with holes 71 and tab 74 are connected directly to base component 61. In some embodiments, if base component 61 is made up of one or more alternative materials, such alternative materials may include materials with properties that allow wireless signals to pass through it. In some embodiments, if base component 61 is made up of a combination of materials (e.g., metal and plastic), the area of raised curved feature 75 and surrounding area may be configured to enable wireless signals to pass through.

Figure 8:
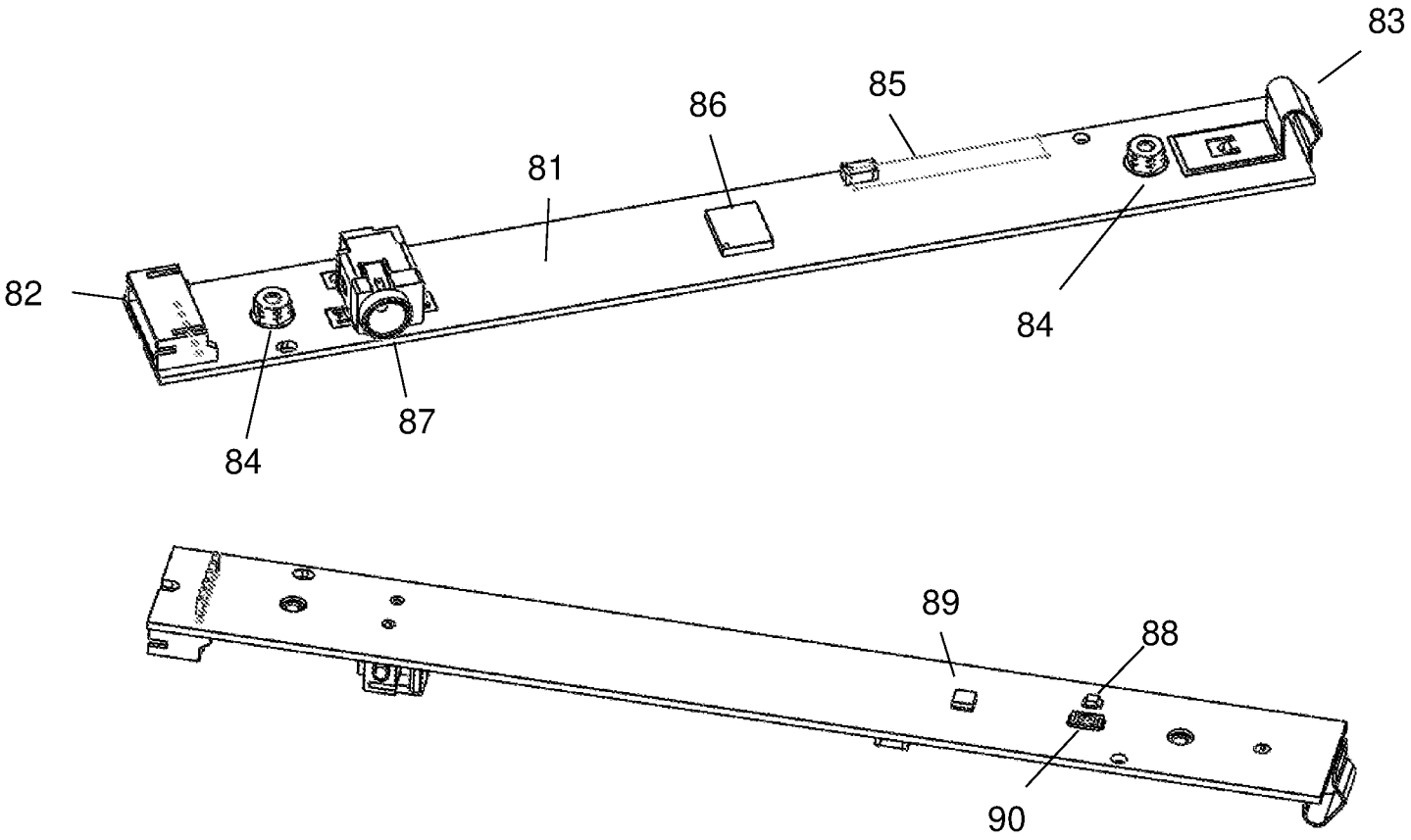
FIG. 8 shows the printed circuit board assembly (PCBA) features of the motorized wand.

As shown in FIG. 8, PCBA 62 has many features and components. In some embodiments, the circuit board 81 is long and narrow to fit inside tubular housing 20. At one end is a connector 82 for motor/encoder assembly 63 (not shown), a microprocessor (not shown), a spring battery terminal 83 connected to a positive power circuit line, a pair of threaded nuts 84 that are electrically connected to a negative power circuit line, an embedded wireless antenna 85 (the embedded antenna can be connected to PCBA for better connection, as well as communicating via different signal type), an onboard wireless chip 86, a power input jack 87, a LED 88, one or more sensors 89 (e.g., a light sensor, an accelerometer/gyroscope, temperature sensor, a current sensor, etc.), a small, low profile button switch 90 (which can act as a rest switch (i.e., set to factory default) or as "set" switch to mark the two end positions of the blind depending on frequency of pressing the switch), and many other features. In certain embodiments, PCBA 62 includes a battery charging circuit to enable the use of rechargeable batteries (e.g., Ni-Cad or other rechargeable batteries). In another aspect, there is also a protection component to prevent damage to PCBA 62 in case of incorrect or improper battery installation.

Power input jack 87 is, preferably, a 3-circuit jack that allows for the S-Wand to be powered by external sources (e.g., DC power, solar power, or other sources). Power input jack 87 may be configured to allow the power source to come from only one power source at a time (and not multiple at a time). Power input jack 87 allows the S-Wand to automatically determine which form of power source is installed. Power input jack 87 has the capability of having two connections simultaneously and can decide which to use or automatically switch to another power source if one source is unusable. For example, if power input jack 87 has a plug inserted into it, and batteries within the wand are not usable or drained, power input jack 87 will draw AC power rather than power from the drained batteries (instead of being inoperable due to no battery power).

Preferably, additional hardware elements are included on PCBA 62, including: an ambient light sensor, which captures the amount of light the wand can sense and react to various conditions; a LDO/PWM (Pulse Width Modulation) voltage regulator 3 v, which allows a consistent 3 volts and allows a set current to be provided to the motor, and as batteries drain, the motor will always get at least 3 volts resulting in consistent speed and torque; an accelerometer/gyroscope, which captures any movement in the wand in order to react, in real time, to different movements; a current sense, which captures current going to the motor; a diode, used for trickle-charging with solar power, to prevent any current flowing backward; a power barrel connector that allows for any power source to be plugged into the wand. In a further aspect, reverse power protection is provided to prevent damage to components in case of incorrect or improper battery installation.

The current sense feature provides the ability to control the torque applied to the blinds via current sensing. Since there are many sizes of vertical and horizontal blinds, by adjusting the current delivered to the motor, the current sense will allow for torque to be adjusted so it will have sufficient power to turn the slats/louver of the blinds to open/close position. In some instances, the torque may need to be decreased for small and new blinds but increased for large or old blinds.

Figure 9:
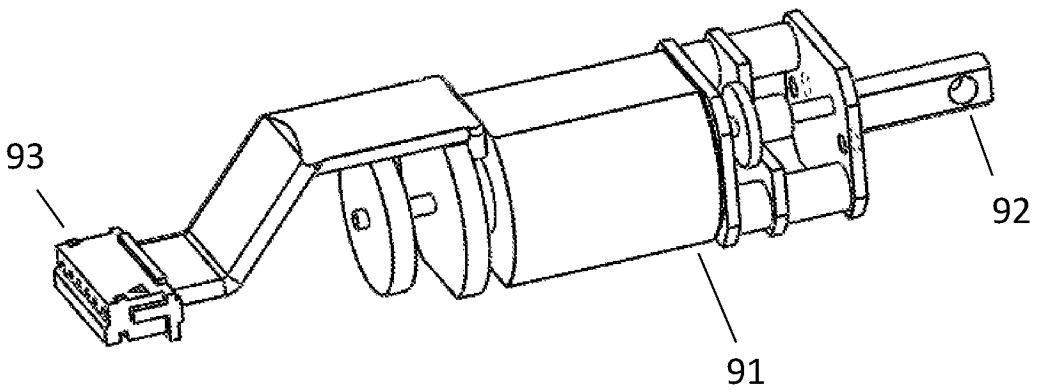
FIG. 9 shows the motor/encoder assembly feature of the motorized wand of the instant invention.

Motor/encoder assembly 63 is further detailed in FIG. 9 and is, preferably, a small DC motor with a gearhead and encoder 91. It includes a customized shaft with a hole 92 for attaching a coupling attachment. The cable includes a connector 93 that mates to the connector on PCBA 62.

Figure 10:
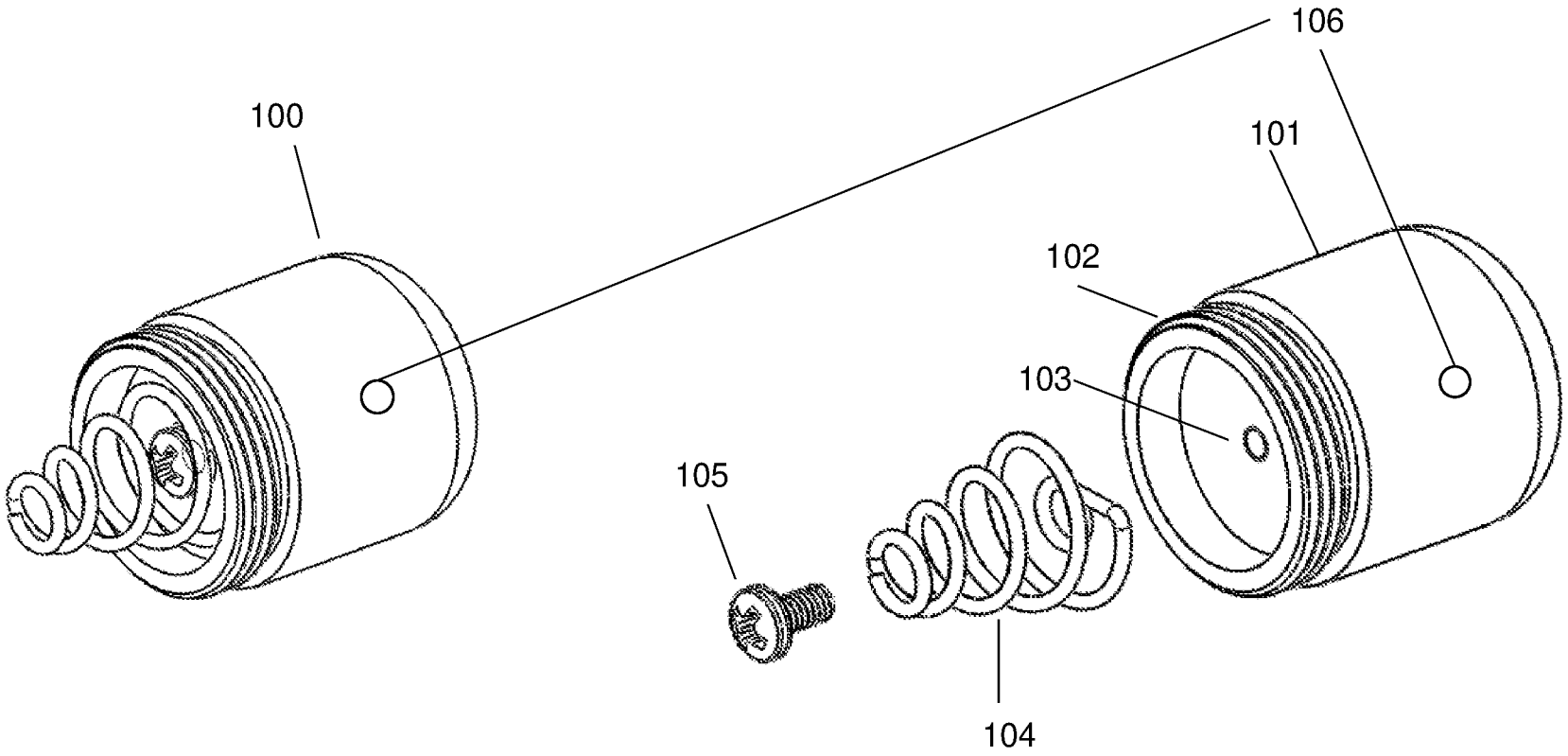
FIG. 10 shows the end cap assembly feature of the preferred embodiment of the present invention.

As depicted in FIG. 10, the end cap assembly 100 comprises an aluminum body 101 that has external threads 102 that match the threads in the end of tubular housing 20. The internal end of the body has an internal screw thread 103. In some embodiments, a battery spring coil 104 is fastened to the uncoated surface with a small screw 105. In a preferred embodiment, aluminum body 101 further includes a hole 106 for insertion of a pin in order to use an optional wand extension element. In some embodiments, the threads and internal surface of the body are left uncoated to allow for a good electrical connection from spring coil 104 to the threads that mate to the internal threads of the tube.

Figure 11:
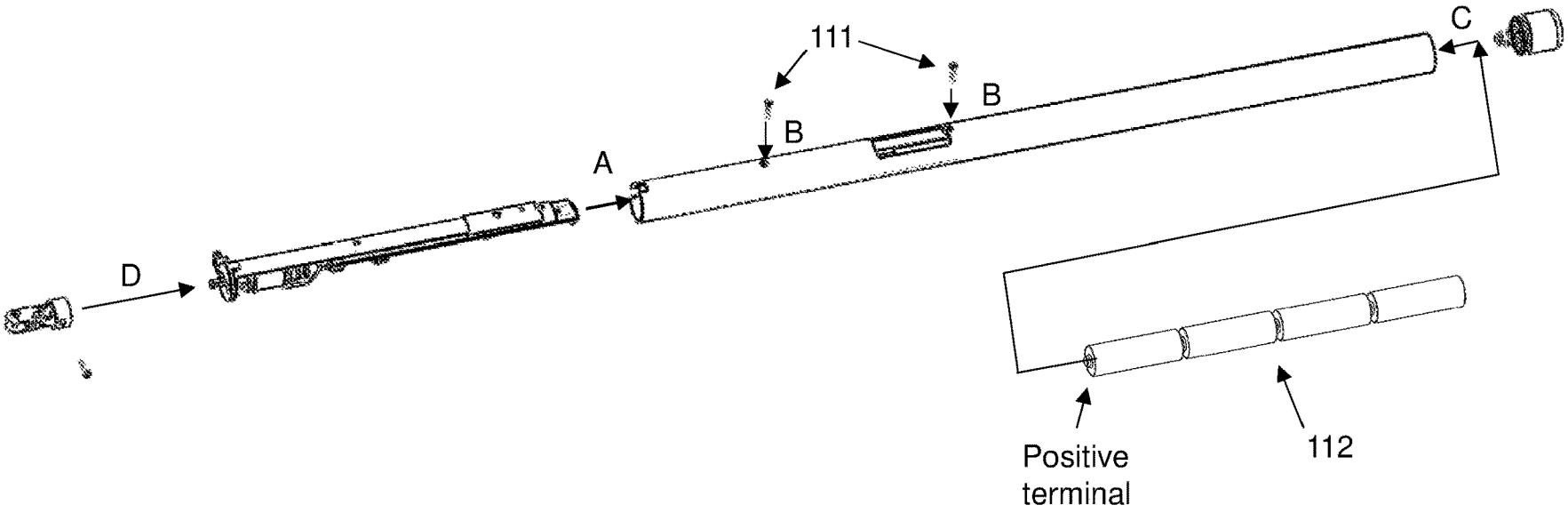
FIG. 11 shows the assembly methods of the preferred embodiment of the present invention.

The assembly of the motorized wand of the instant invention is further described in FIG. 11. (A) Electronics and motor insert assembly 60 is slide into tube 30 from the notched end with hole bosses 72 on base component 61 aligned to the notches. (B) Insert two screws 111 through countersunk holes **43*b* and through pair of holes 76 in base component 61 and thread them into the two nuts on PCBA 62. (C) Screw end cap assembly 100 onto the threaded end of tube 30. (D) Install the coupling onto the motor shaft (further described in FIG. 12). To install the batteries 112, remove end cap assembly 100 and slide batteries 112 into tube 30**, positive terminal first.

Figure 12:
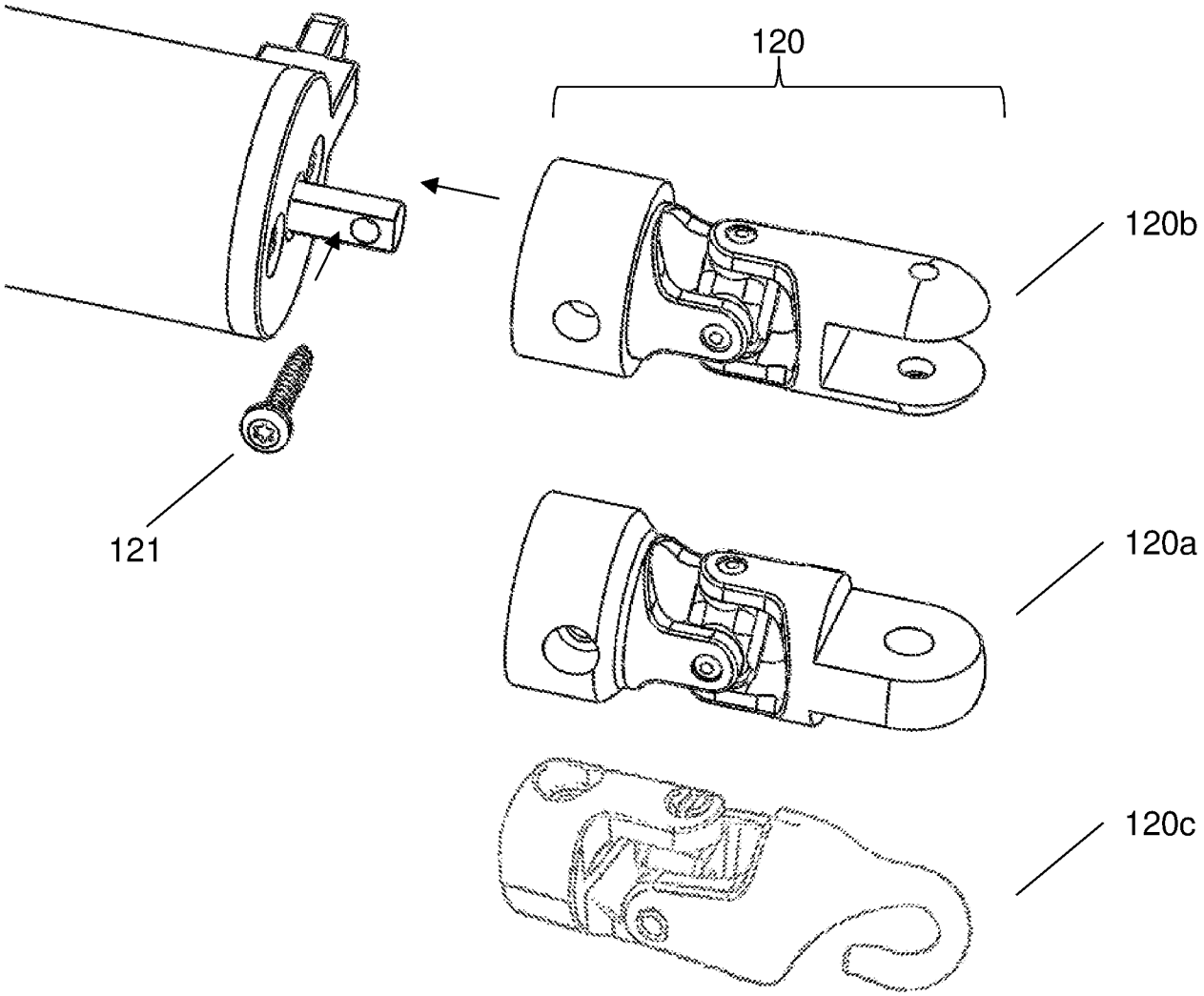
FIG. 12 shows the coupling assembly feature of the preferred embodiment of the present invention.

As shown in FIG. 12, the plastic coupling assembly 120 comes in male coupling **120*a*, female coupling 120*b* and hook coupling 120*c* versions. It is attached to the motor shaft on the wand by a matching D-shaped recess and small thread forming screw 121**.

It is well known in the art that blind sets are manufactured in horizontal and vertical slat versions and both are common. The motorized wand of the present invention is designed to work with horizontal or vertical blind versions by use of male and female couplings and different versions of anti-rotation brackets.

Figure 13:
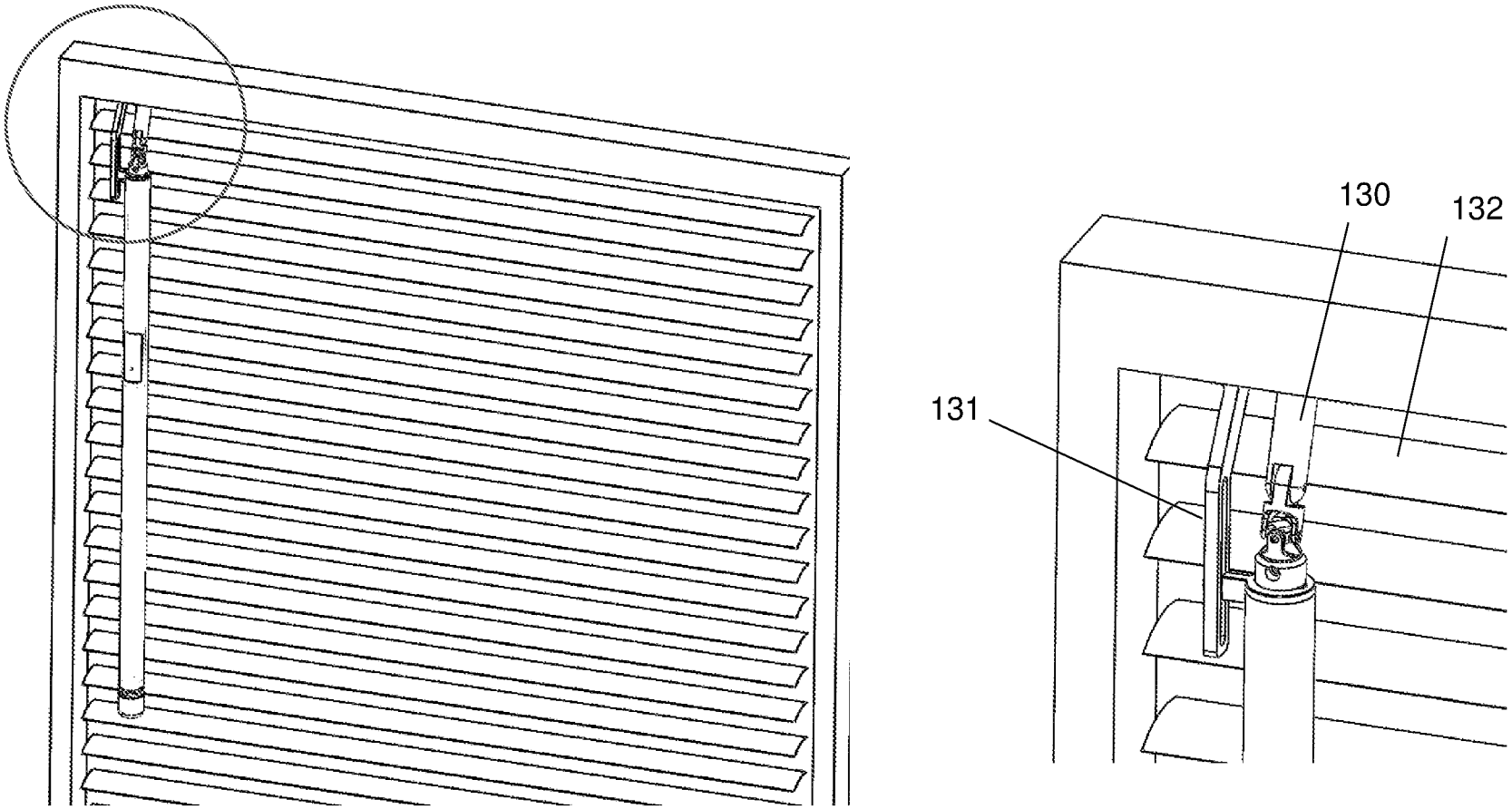
FIG. 13 shows an example of the motorized wand installed on horizontal blinds with the preferred anti-rotation bracket and appropriate spindle.

A preferred embodiment of the wand of the instant invention is shown in FIG. 13. In the example shown, the blinds are horizontal but could be hanging vertical. In either horizontal or vertical versions there is always a spindle 130 suspended from the upper housing of the blind set.

The manual wand provided by the manufacturer is removed from spindle 130 by whatever connection method is provided by the manufacturer. There are many styles of connections including screws and snap-in based. In this example, spindle 130 is a female version, but both male and female spindles are common.

The S-Wand comes with male, female or hook couplings as described in FIG. 12. In accordance with FIG. 13, once the S-Wand is connected to spindle 130, a horizontal anti-rotation bracket 131 is placed on the header or headrail of the blind set. There are multiple versions of anti-rotation brackets provided for horizontal, vertical and different sized slats. The version shown in FIG. 13 is shaped for horizontal slats 132 that are larger in size, however, it will work with smaller size blinds (ie. mini-blinds). Bracket 131 should be aligned to mate with protruding tab 74 from the side of the S-Wand. Protruding tab 74 is designed to fit snugly into the slot on bracket 131 but sized to easily be pulled from the slot should the user want to operate the S-Wand manually.

Figure 14:
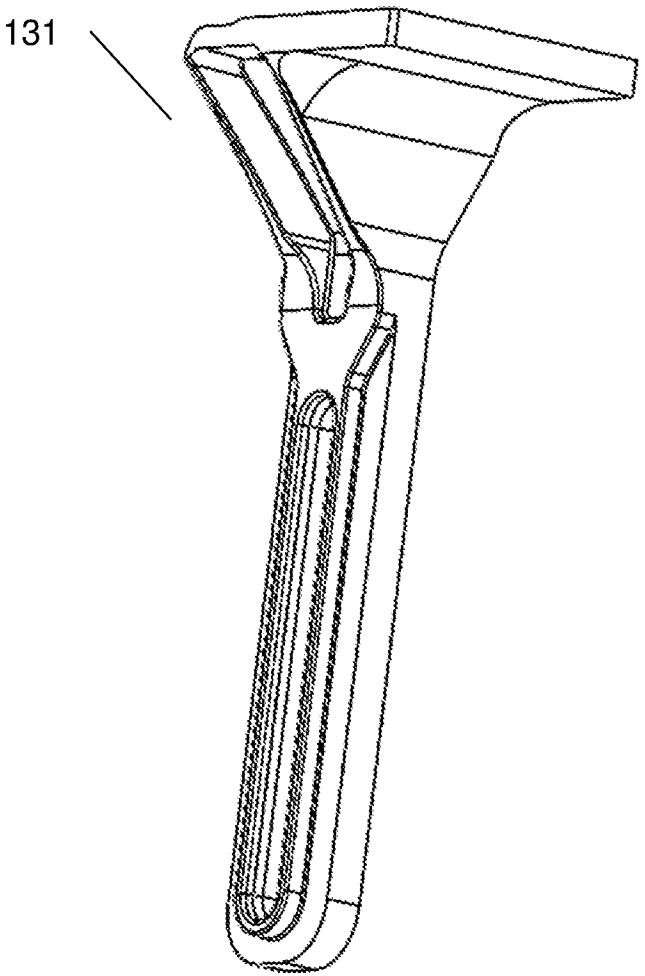
FIG. 14 shows a perspective view of the horizontal anti-rotation bracket for use with horizontal blinds.

FIG. 14 shows a detailed, perspective view of horizontal anti-rotation bracket 131.

Figure 15:
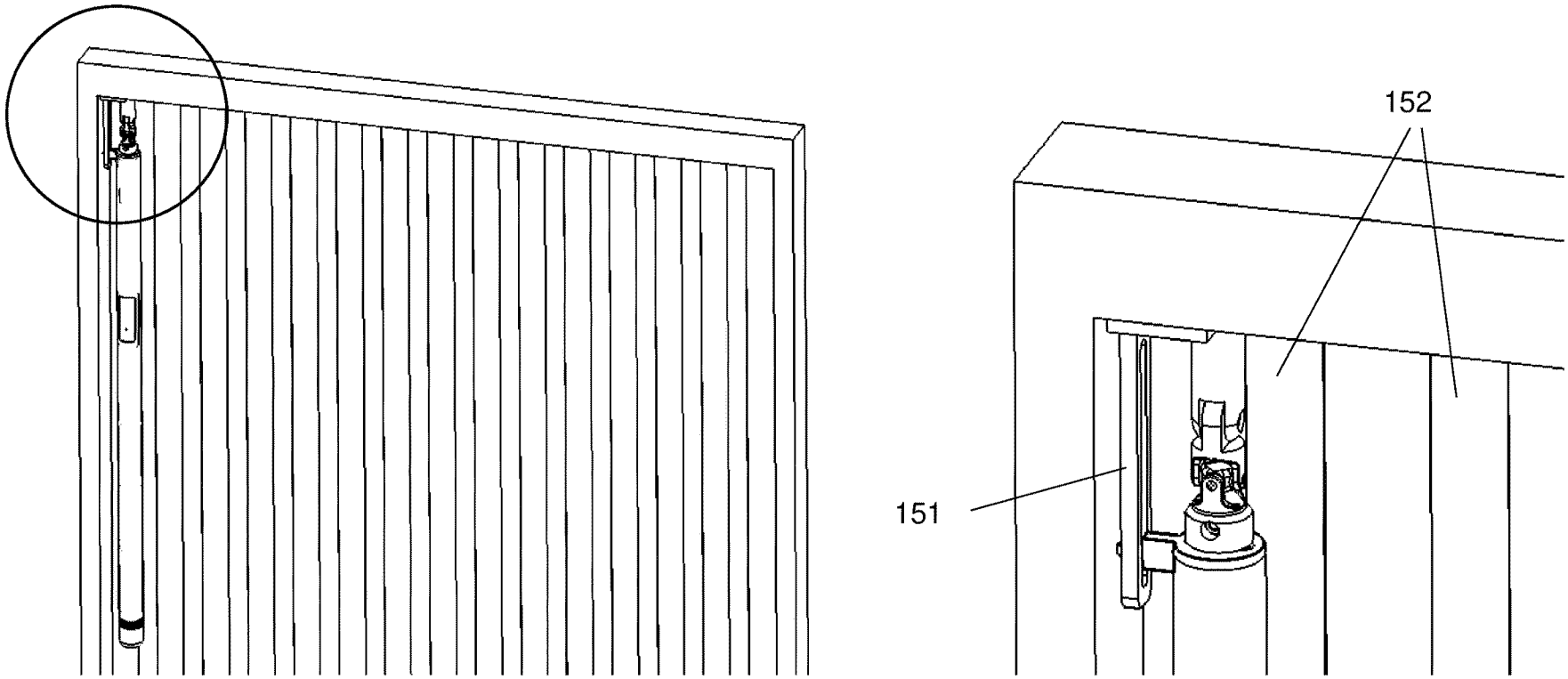
FIG. 15 shows an example of the motorized wand installed on vertical blinds with the preferred anti-rotation bracket and appropriate spindle.

The S-Wand is shown with a vertical blind embodiment in FIG. 15. Vertical slats 152 hang vertically from the header. In the vertical blind embodiment, a vertical anti-rotation bracket 151 is required. Depending on the vertical blind design, there could be multiple versions of vertical anti-rotation bracket 151 to fit properly.

Figure 16:
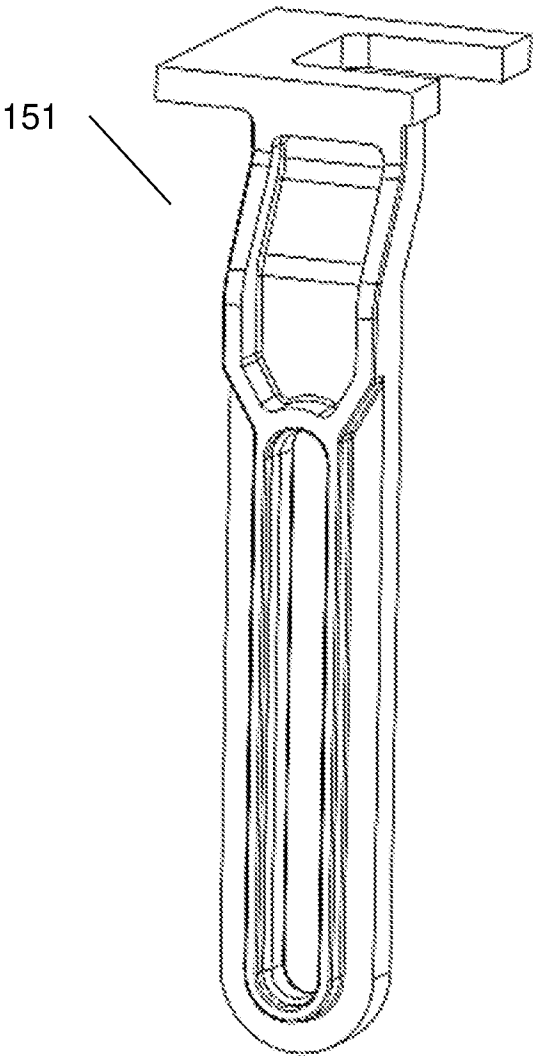
FIG. 16 shows a perspective view of the vertical anti-rotation bracket for use with vertical blinds.

FIG. 16 shows a detailed, perspective view of vertical anti-rotation bracket 151.

In some embodiments, one or more computing devices may be programmed to perform the functions described herein. The computing devices may include one or more electronic storages, one or more physical processors programmed with one or more computer program instructions, and/or other components. The computing devices may include communication lines or ports to enable the exchange of information within a network or other computing platforms via wired or wireless techniques (e.g., Ethernet, fiber optics, coaxial cable, WiFi, Bluetooth, near field communication, or other technologies). The computing devices may include a plurality of hardware, software, and/or firmware components operating together. For example, the computing devices may be implemented by a cloud of computing platforms operating together as the computing devices.

The electronic storages may include non-transitory storage media that electronically stores information. The storage media of the electronic storages may include one or both of (i) system storage that is provided integrally (e.g., substantially non-removable) with servers or client devices or (ii) removable storage that is removably connectable to the servers or client devices via, for example, a port (e.g., a USB port, a firewire port, etc.) or a drive (e.g., a disk drive, etc.). The electronic storages may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storages may include one or more virtual storage resources (e.g., cloud storage, a virtual private network, and/or other virtual storage resources). The electronic storage may store software algorithms, information determined by the processors, information obtained from servers, information obtained from client devices, or other information that enables the functionality as described herein.

The processors may be programmed to provide information processing capabilities in the computing devices. As such, the processors may include one or more of a digital processor, an analog processor, a digital circuit designed to process information, an analog circuit designed to process information, a state machine, and/or other mechanisms for electronically processing information. In some embodiments, the processors may include a plurality of processing units. These processing units may be physically located within the same device, or the processors may represent processing functionality of a plurality of devices operating in coordination. The processors may be programmed to execute computer program instructions to perform functions described herein. The processors may be programmed to execute computer program instructions by software; hardware; firmware; some combination of software, hardware, or firmware; and/or other mechanisms for configuring processing capabilities on the processors.

Figure 17:
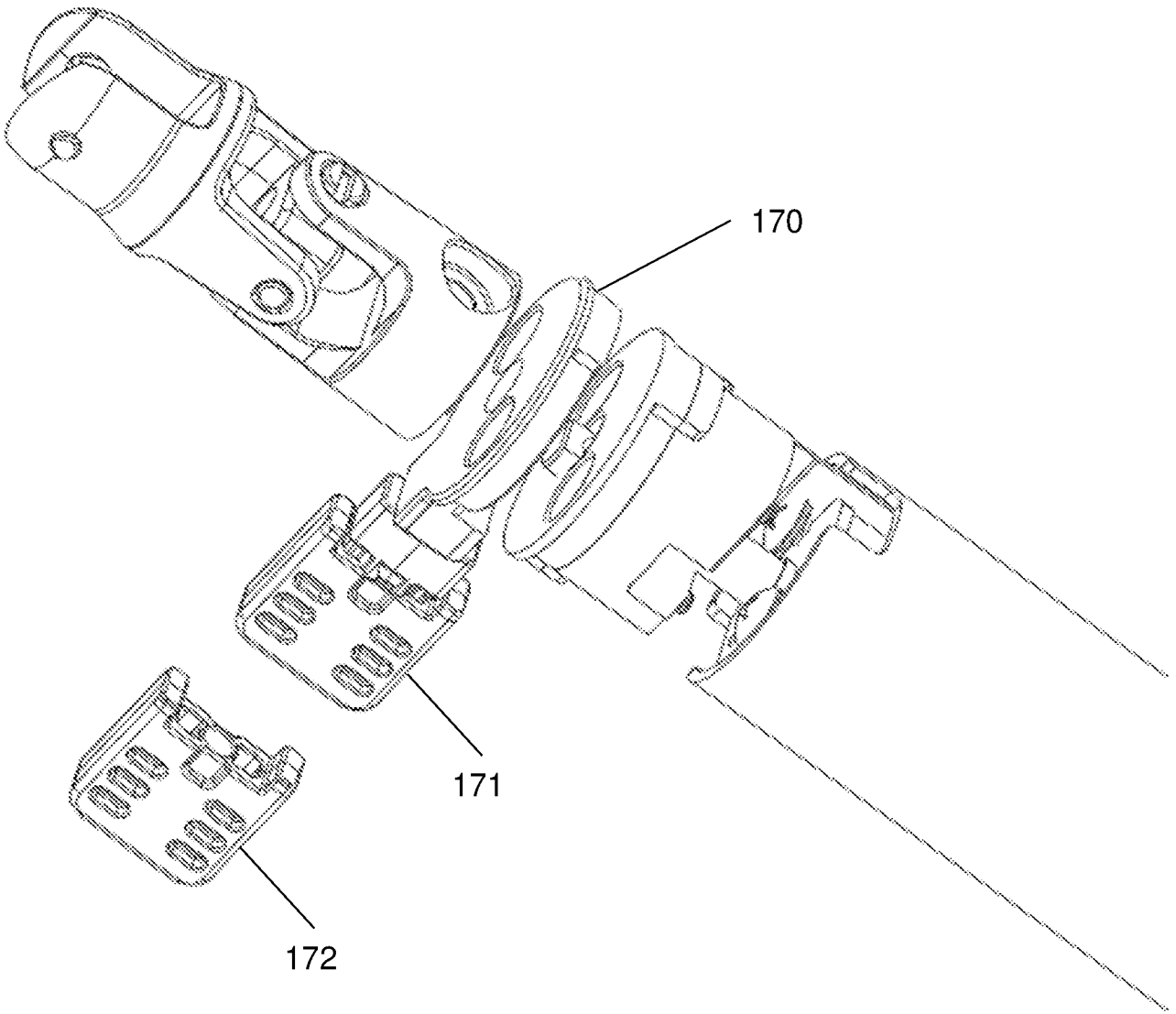
FIG. 17 shows a detailed view of the antirotating element with tab features installed at the tip of the wand.

In a preferred embodiment, as shown in FIG. 17, the present invention provides for an antirotating element 150 that is detachable and positioned at the tip of the wand. Antirotating element 170 includes a tab 171 that is used to lock antirotating element 170 into place. This allows only the spindle coupling at the tip of the wand to rotate as opposed to the entire wand itself. In another aspect, an additional tab 172 may be, optionally, added to tab 171 in order to reach a bracket that is too far away for a standard-length tab.

Figure 18:
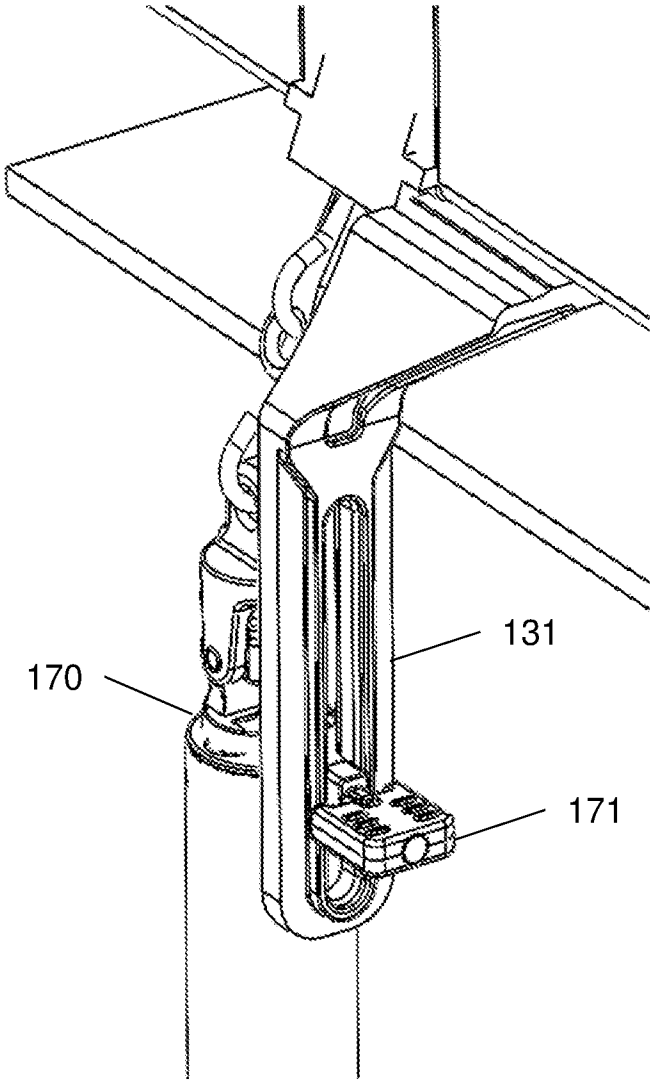
FIG. 18 shows an exemplary view of the antirotating element with the tab extending through the bracket in a locked position.

FIG. 18 depicts how antirotating element 170 and tab 171 locks the spindle coupling in place to allow only the tip of the wand to rotate and preclude the entire wand from rotating. Tab 171 is inserted through the bracket 131, and twisted approximately 90 degrees, thus resulting in tab 171 being in horizontal position relative to the vertical opening in bracket 131. This serves to lock the wand to bracket 131.

Optionally, the wand may be converted to manual use by untwisting tab 171 from a horizontal position to a vertical position in order to remove tab 171 from bracket 131. When a user sets up the wand for the first time or resets the system, the following will preferably occur. The user will position the slats or louvers to one end and the system activation will automatically move them to the other, extreme end. Once the system sees such a change in resistance, it will identify each extreme end and the encoder will track same by counting of the geared motor's shaft turns from one end to the other. Thus, the user will then have the ability to choose any position from one extreme end (0% open; 100% close) to the other (100% open; 0% close) or any position in between (30% open; 70% close, for example) for automation or remote use. Alternatively, the user may position the slats or louvers to one end and mark the position in the system by use of a physical button (remote control) or a virtual button (a phone or software app).

The wand utilizes the accelerometer/gyroscope component to determine if the system was used manually or not. If the wand was last used manually, the system will conduct a full reset at the end of manual use or at the beginning of the next operation. When the system senses a sudden movement in any direction or a tilt position change that falls outside of the normal operation, it will interpret this as a manual use and the system will have to do a reset in order to have the accurate two end positions of the slats or louvers. The accelerometer/gyroscope component can work in any of methods described supra and the reset will be based on one of these methods unless an automatic safety halt is triggered.

Preferably, bracket 131 is attached to a header or headrail of the set of blinds. Most preferably, antirotating element 150 is reversible, thereby being capable of use with a set of blinds having a left-hand or right-hand tilt mechanism assembly. In this embodiment, antirotating element 150 is adjusted by removing the two screws holding it in place and flipping antirotating element 150 in the desired position to allow tab 171 to be inserted through bracket 131. Similarly, if antirotating element 150 requires replacement, it may be detached and replaced by removing the two screws holding it in place, reattaching a new antirotating element, then replacing the two screws to complete reinstallation.

Figure 19:
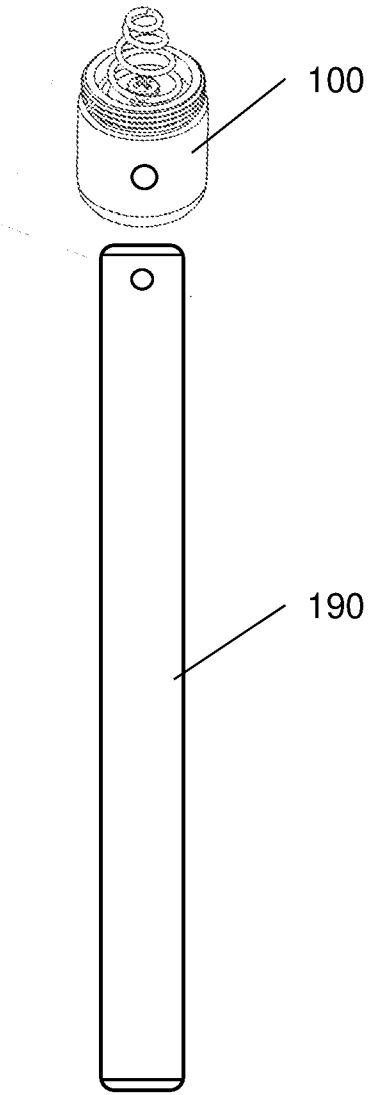
FIG. 19 shows a wand extension to be utilized at the end of the wand for elongation purposes.

FIG. 19 shows an optional wand extension for use in elongating a standard-length wand to accommodate taller-than-standard blind sets. In this embodiment, wand extension 190 is added to tube 30 at end cap assembly 100.

Figure 20:
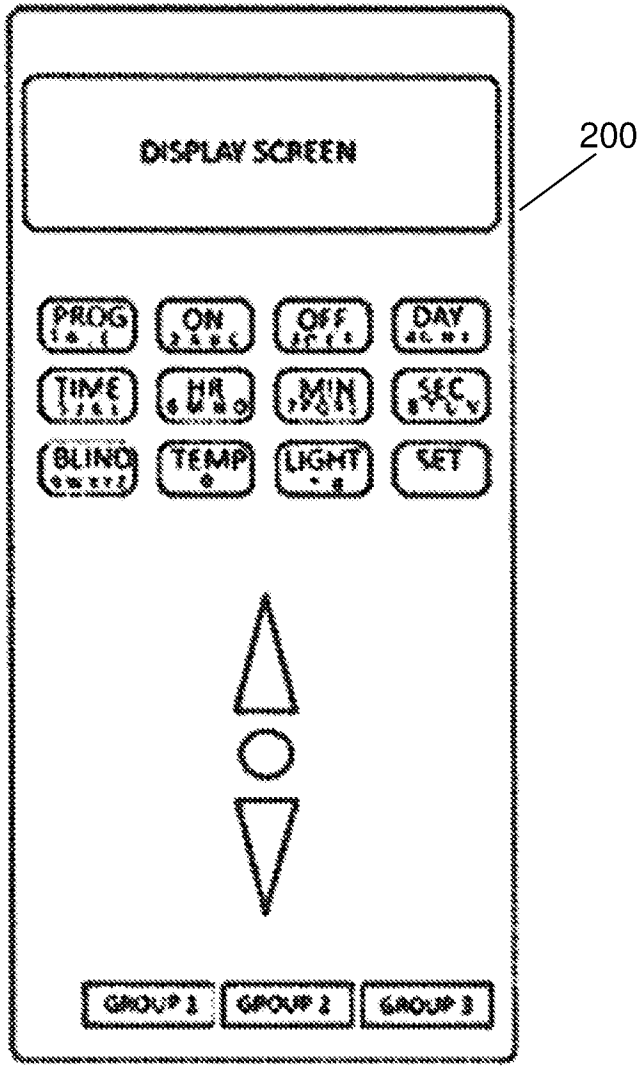
FIG. 20 shows an exemplary remote control for use in controlling the wand of the present invention.

FIG. 20 shows an exemplary embodiment of a remote-control device for remotely controlling the S wand. Remote control 200 can be used as an alternative to app-based interfaces or smart devices, and will allow operational control of the wand in case of user preference or inoperability of smart devices (ie. no internet connection signal, etc.). Using remote control 200 will allow a user to enable the WiFi router/hub to communicate with S wand but it will be limited to local connection and no remote connection. In such an instance, setting of the blinds will be done via remote control instead of the smart device features.

Figure 21:
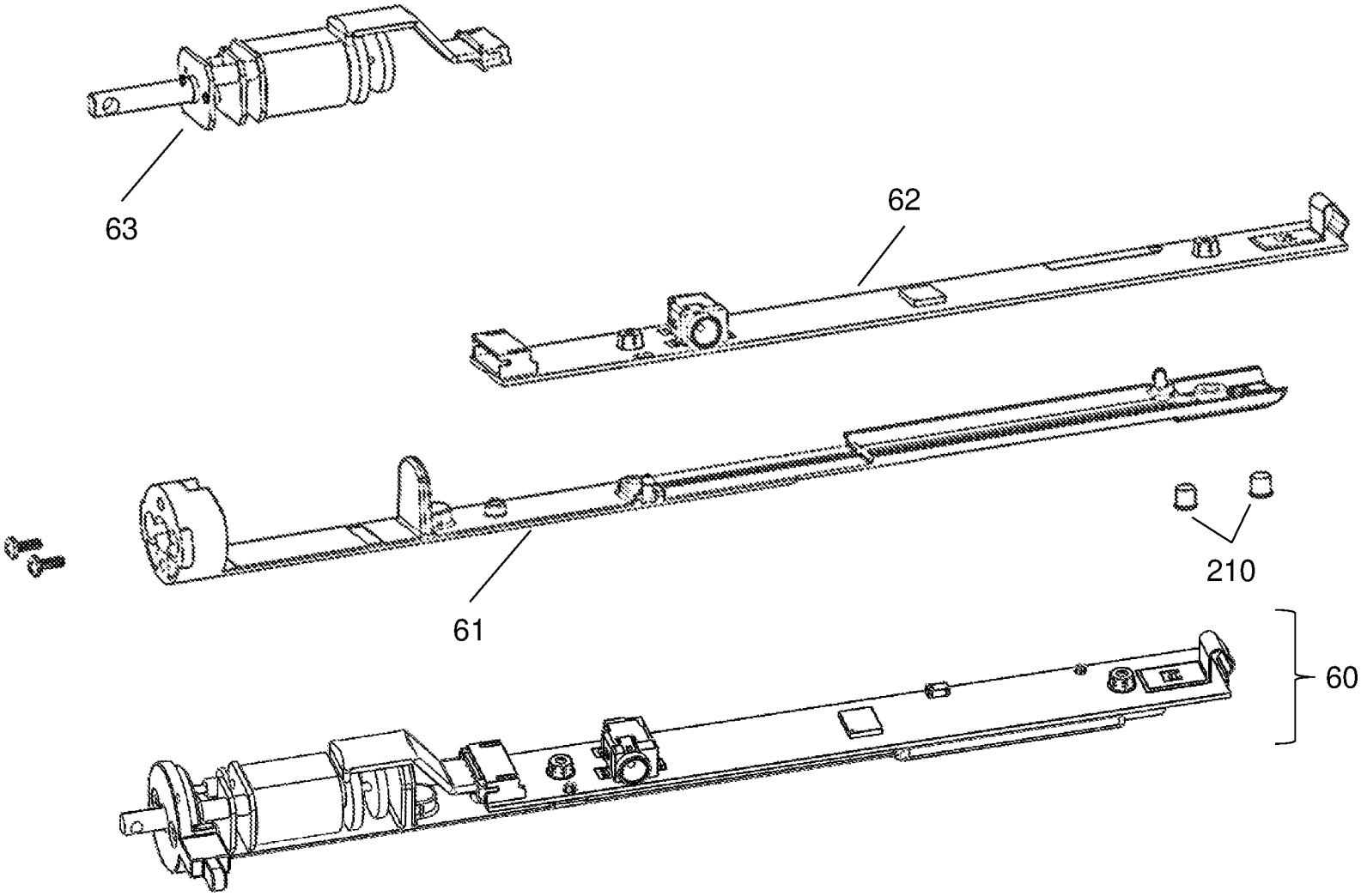
FIG. 21 shows a diagram of each feature that comprises the electronics and motor insert assembly of the present invention, including the motor/encoder, PCBA, hole plugs and base component.

FIG. 21 represents the individual components of electronics and motor insert assembly 60, which includes motor/encoder assembly 63 attached to PCBA 62, which lays on top of base component 61. Hole plugs 210 are included for attachment to base component 61.

All of the features disclosed in this specification may be combined in any combination. Each feature disclosed in this specification may be replaced by an alternative feature serving the same, equivalent, or similar purpose. Thus, unless expressly stated otherwise, each feature disclosed is only an example of a generic series of equivalent or similar features. As used in this specification and in the appended claims, the singular forms include the plural forms. For example, the terms "a," "an," and "the" include plural references unless the content clearly dictates otherwise. Additionally, the term "at least" preceding a series of elements is to be understood as referring to every element in the series. The inventions illustratively described herein can suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the future shown and described or any portion thereof, and it is recognized that various modifications are possible within the scope of the invention claimed. Thus, it should be understood that although the present invention has been specifically disclosed by preferred embodiments and optional features, modification and variation of the inventions herein disclosed can be resorted by those skilled in the art, and that such modifications and variations are considered to be within the scope of the inventions disclosed herein. The inventions have been described broadly and generically herein. Each of the narrower species and subgeneric groupings falling within the scope of the generic disclosure also form part of these inventions. This includes the generic description of each invention with a proviso or negative limitation removing any subject matter from the genus, regardless of whether or not the excised materials specifically resided therein. In addition, where features or aspects of an invention are described in terms of the Markush group, those schooled in the art will recognize that the invention is also thereby described in terms of any individual member or subgroup of members of the Markush group. It is also to be understood that the above description is intended to be illustrative and not restrictive. Many embodiments will be apparent to those of in the art upon reviewing the above description. The scope of the invention should therefore, be determined not with reference to the above description, but should instead be determined with reference to the appended claims, along with the full scope of equivalents to which such claims are entitled. Those skilled in the art will recognize, or will be able to ascertain using no more than routine experimentation, many equivalents to the specific embodiments of the invention described. Such equivalents are intended to be encompassed by the following claims.

We claim:

1. A motorized wand for controlling opening and closing of at least one set of blinds, comprising:

a tubular housing;

a printed circuit board assembly, a geared motor, a current sensor, and an encoder that are within the tubular housing;

a spindle coupling component; and an antirotating element placed (i) into and over one end opening of the tubular housing and (ii) between the spindle coupling component and the tubular housing, the antirotating element having a rotatable protruding tab that extends outward away from a surface of the tubular housing and is configured to be rotated into a lock position that locks the wand to a bracket, wherein the printed circuit board assembly is configured to:

use the encoder to determine a position of slats or louvers of the at least one set of blinds; and dynamically control a torque of the geared motor by using the current sensor and a shut-off current threshold to (i) adjust an amount of current delivered to the geared motor and (ii) shut off the geared motor, wherein the geared motor is shut off in response to the amount of current reaching the shut-off current threshold.

2. The wand of claim 1, wherein the wand comprises an end cap that has a battery spring coil and is located at another end of the tubular housing opposite the one end opening.

3. The wand of claim 1, wherein the adjustment of the amount of current is based on size and weight parameters of the slats or louvers of the at least one set of blinds.

4. The wand of claim 1, wherein the wand comprises a temperature sensor within the tubular housing, and wherein the printed circuit board assembly is further configured to:

detect, using the temperature sensor within the tubular housing, a predetermined temperature of an environment of the wand; and perform a preset action based on the detection of the predetermined temperature.

5. The wand of claim 1, wherein the wand comprises a light sensor within the tubular housing, and wherein the printed circuit board assembly is further configured to:

detect, using the light sensor within the tubular housing, a predetermined amount of light in an environment of the wand; and perform a preset action based on the detection of the predetermined amount of light.

6. The wand of claim 1, wherein the wand comprises a movement sensor within the tubular housing, and the printed circuit board assembly is further configured to:

detect, using the movement sensor within the tubular housing, manual use of the wand; and perform a reset operation of the wand based on the detection of the manual use.

7. The wand of claim 6, wherein the movement sensor comprises one or more accelerometer or gyroscope components.

8. A motorized wand for controlling opening and closing of at least one set of blinds, comprising:

a tubular housing;

a printed circuit board assembly, a geared motor, and an encoder that are within the tubular housing; and an antirotating element at one end of the tubular housing, the antirotating element having a rotatable protruding tab that extends outward away from a surface of the tubular housing and is configured to be rotated into a lock position that locks the wand to a bracket, wherein the printed circuit board assembly is configured to:

use the encoder to determine a position of slats or louvers of the at least one set of blinds; and control an adjustment of an amount of current delivered to the geared motor.

9. The wand of claim 8, wherein controlling the amount of current comprises dynamically controlling a torque of the geared motor by using a current sensor and a shut-off current threshold to (i) adjust the amount of current delivered to the geared motor and (ii) shut off the geared motor, wherein the geared motor is shut off based on the amount of current reaching the shut-off current threshold.

10. The wand of claim 8, wherein the wand comprises an end cap that has a battery spring coil and is located at another end of the tubular housing opposite the one end opening.

11. The wand of claim 8, wherein the adjustment of the amount of current is based on size and weight parameters of the slats or louvers of the at least one set of blinds.

12. The wand of claim 8, wherein the wand comprises a temperature sensor within the tubular housing, and wherein the printed circuit board assembly is further configured to:

detect, using the temperature sensor within the tubular housing, a predetermined temperature of an environment of the wand; and perform a preset action based on the detection of the predetermined temperature.

13. The wand of claim 8, wherein the wand comprises a light sensor within the tubular housing, and wherein the printed circuit board assembly is further configured to:

detect, using the light sensor within the tubular housing, a predetermined amount of light in an environment of the wand; and perform a preset action based on the detection of the predetermined amount of light.

14. The wand of claim 8, wherein the wand comprises a movement sensor within the tubular housing, and the printed circuit board assembly is further configured to:

detect, using the movement sensor within the tubular housing, manual use of the wand; and perform a reset operation of the wand based on the detection of the manual use.

15. The wand of claim 14, wherein the movement sensor comprises one or more accelerometer or gyroscope components.

16. A motorized wand for controlling opening and closing of at least one set of blinds, comprising:

a tubular housing;

a printed circuit board assembly, a geared motor, a current sensor, and an encoder that are within the tubular housing; and an antirotating element at one end of the tubular housing, the antirotating element having a protruding tab that extends outward away from a surface of the tubular housing and that is configured to lock the wand to one or more components, wherein the printed circuit board assembly is configured to:

use the encoder to determine a position of slats or louvers of the at least one set of blinds; and dynamically control a torque of the geared motor by using the current sensor and a shut-off current threshold to (i) adjust an amount of current delivered to the geared motor and (ii) shut off the geared motor, wherein the geared motor is shut off based on the amount of current reaching the shut-off current threshold.

17. The wand of claim 16, wherein the wand comprises a temperature sensor within the tubular housing, and wherein the printed circuit board assembly is further configured to:

detect, using the temperature sensor within the tubular housing, a predetermined temperature of an environment of the wand; and perform a preset action based on the detection of the predetermined temperature.

18. The wand of claim 16, wherein the wand comprises a light sensor within the tubular housing, and wherein the printed circuit board assembly is further configured to:

detect, using the light sensor within the tubular housing, a predetermined amount of light in an environment of the wand; and perform a preset action based on the detection of the predetermined amount of light.

19. The wand of claim 16, wherein the wand comprises a movement sensor within the tubular housing, and the printed circuit board assembly is further configured to:

detect, using the movement sensor within the tubular housing, manual use of the wand; and perform a reset operation of the wand based on the detection of the manual use.

20. The wand of claim 19, wherein the movement sensor comprises one or more accelerometer or gyroscope components.

* * * * *